US006873295B2

(12) United States Patent
Davies

(10) Patent No.: US 6,873,295 B2
(45) Date of Patent: Mar. 29, 2005

(54) ANTENNA

(75) Inventor: John Davies, Stockport (GB)

(73) Assignee: BSH Industries Limited, Lancashire (GB)

( * ) Notice: Subject to any disclaimer, the term of this patent is extended or adjusted under 35 U.S.C. 154(b) by 0 days.

(21) Appl. No.: 10/341,602

(22) Filed: Jan. 14, 2003

(65) Prior Publication Data

US 2004/0080460 A1 Apr. 29, 2004

Related U.S. Application Data

(63) Continuation of application No. PCT/GB01/03161, filed on Jul. 12, 2001.

(30) Foreign Application Priority Data

Jul. 14, 2000 (GB) ..... 0017415

(51) Int. Cl.[7] ..... H01Q 1/32
(52) U.S. Cl. ..... 343/704; 343/713
(58) Field of Search ..... 343/713, 704, 343/711, 712; H01Q 1/32

(56) References Cited

U.S. PATENT DOCUMENTS 5,640,167 A * 6/1997 Hall ..... 343/713
6,268,832 B1 * 7/2001 Twort et al. ..... 343/713

FOREIGN PATENT DOCUMENTS

| | | |
|---|---|---|
| EP | 0993067 | 4/2000 |
| EP | 1014478 | 6/2000 |
| GB | 2293693 | 4/1996 |

* cited by examiner

*Primary Examiner*—HoangAnh T. Le
(74) *Attorney, Agent, or Firm*—Shoemaker and Mattare

(57) ABSTRACT

A radio antenna formed on a window pane includes parallel heating elements extending between busbars at opposite edges of the pane. Plural interconnecting elements extend across the heating elements. The length from the midpoint of a busbar to the point of connection of the interconnecting element, measured along the busbar and then along the heating element, is approximately $\lambda/4+N(\lambda/2)$, where n is an integer greater than or equal to zero, and $\lambda$ is a select wavelength from the band of signals to be received.

12 Claims, 4 Drawing Sheets

ANTENNA

This application is a continuation of PCT/GB01/03161, filed Jul. 12, 2001.

The present invention relates to antennas. The antennas to which this invention relates will most typically find application in a vehicle and preferably can be used for VHF radio reception in the range of 76–110 MHz. However, antennas of the present invention may be used in other circumstances and other ranges (VHF or otherwise) and are not restricted to use with audio broadcasts.

A motor vehicle, being a cage of metal, is internally largely shielded from external radio signals. It is thus necessary to provide an antenna for a radio receiver operating within the vehicle.

Traditionally, antennas for motor vehicles comprise a metal mast or rod which projects, in use, from the vehicle body. The disadvantages of these have been long-recognized, such that technology has been available for many years whereby an antenna can be formed from conductive elements on a glass pane of the vehicle such as those used for rear-screen heating. Such antennas, in their broadest sense, will be referred to herein as window mounted antennas.

One reason why window mounted antennas are not universally used is that their cost is greater than the equivalent metal mast or rod antenna. This has not been due to the cost of providing a special glass pane; this is negligible. Rather, this has been due to the cost of the interface circuitry required. Most particularly, the interface circuitry has included active components for amplification of the signal received to a level suitable for feeding to a radio receiver.

An additional disadvantage of window mounted antennas (which conventionally include active components) is that the signal-to-noise ratio of the output from such antennas has not been as good as that of traditional mast types.

Various attempts have been made to improve the performance of window mounted antennas. These have included variations in the interface circuitry, changes to the pattern of conductive elements, and providing separate conductive elements dedicated to radio reception and which play no part in heating the window. However, these attempts have not removed the above disadvantages.

In arriving at the present invention, the applicants have recognised that there has been acceptance that a window mounted antenna will be disadvantaged through being mounted within a conductive surround of uncontrolled behaviour at radio frequencies. A rear screen of a vehicle has properties similar to a slot antenna in a ground plane, but its resonance properties are uncontrolled and correspond only by coincidence with frequencies of signals to be received. Previously, attempts have been made to improve the signal derived from a disadvantageously disposed antenna. One such attempt is disclosed in GB 2293693, the disclosure of which is incorporated herein by reference.

With reference to FIG. 1, an embodiment of a previous invention by the applicant, as disclosed in GB2293693 comprises a glass rear screen 1 (known in the art as "a heated backlite") for a car on which an array of conductive elements is formed in a manner conventionally used to form a rear screen heater.

The array comprises a pair of busbars 10 which are generally parallel and spaced apart to be disposed adjacent to opposite edges of the screen 1. The busbars 10 are interconnected by a multiplicity of heating elements 14, these being generally parallel and meet the busbars at a regular spacing. A DC voltage derived from the electrical system of the vehicle can, by means of a user control, be selectively applied across the busbars 10, this causing a heating current to flow in the heating elements 14, with the effect of clearing frost or mist from the screen 1. The DC signal is usually connected to the points marked A. As thus far described, the array constitutes a conventional heated screen arrangement.

The structure also operates as an antenna for receiving radio transmissions within a desired frequency range, which is preferably in the VHF range of 76–110 MHz, or more preferably in the VHF range of 88 to 108 MHz.

Each busbar 10 is connected at a respective point A to the vehicle body through a path of low impedance to signals within the desired frequency range. With this embodiment, such connection is made through a series-resonant circuit 16, comprising a series-connected capacitor and inductor, to the vehicle body at 18. The series-resonant circuit is tuned to resonate within the desired frequency range, such that the series-resonant circuit 16 provides a low-impedance path to the vehicle body for signals of such frequencies, but is effectively open-circuit for DC signals.

A series of interconnecting conductive elements 20 are provided which interconnect adjacent heating elements 14. The interconnecting elements 20 are disposed such that they interconnect points on the heating elements which are of a distance traced along a conductive path of typically 0.25λ from the point A of a busbar 10. Where a low-impedance connection at the frequency of operation is implemented to the aperture periphery, this is typically the point at which DC power is supplied to the heater, and symmetrically the point at the DC path to the vehicle earth. As used herein, λ is the wavelength of signals to be received as they propagate in the glass pane. (It is to be remembered that radio signals propagate conductive tracks printed on glass by a typical factor of 0.6 of their speed in free space, their wavelength being shortened accordingly.) Thus, as shown in FIG. 1, the interconnecting elements 20 are disposed on two loci, each centred on a respective point A.

The interconnecting elements 20 are disposed transversely to the heating elements 14 so as to interconnect points of substantially equal DC potential arising from the heating current. In this way substantially no current flows through them, so minimising their interference with the heating effect of the array and also allowing their thickness (and their consequent interference with vision) to be minimised.

Each point A has associated with it a respective plurality of interconnecting elements 20. GB 2293693 teaches that this divides the entire array into three regions, the centre of which 22 constitutes a receiving zone for signals of the desired frequency. The closed loop provided from each point A, through the interconnecting elements is a half-wave resonant structure. GB2293693 teaches that the structure of the outer zones 24 serves to isolate the receiving zone 22 from the effects of the surrounding vehicle, allowing it to operate efficiently.

An output conductive element 26 is connected to a centre point on two of the lowermost heating elements 14. The output element 26 is connected to a suitable terminal at which connection is made to a co-axial feed wire 28 to carry a received radio signal to a radio receiver.

The primary aim of the present invention is to provide a window mounted antenna, particularly but not exclusively for VHF reception in cars, which has a lower cost and/or better performance and/or is easier to fit than has hitherto been available, such as that shown in GB2293693.

GB 2293693 also teaches that optimisation can be further enhanced by providing capacitive coupling elements shown at 50, 52 in FIG. 2, to couple the receiving zone 22 to the surrounding aperture 30 in the vehicle. In a further aspect, the present invention aims to improve the reliability of such capacitive coupling.

In a first aspect, the invention provides an antenna for receiving radio signals e.g. in a vehicle, the antenna including:

an array of conductive elements formed on a window pane e.g. of a vehicle, the array including first and second busbars extending close to respective opposite edges of the pane and a plurality of generally parallel, spaced-apart heating elements interconnecting the busbars;

there being a respective connection for DC power to each busbar; and a plurality of first interconnecting elements, each first interconnecting element extending between first and second heating elements and crossing at least one other heating element, each first interconnecting element being substantially linear and disposed around a respective one of said DC connections such that for each first interconnecting element the length from the respective DC connection, along the busbar to which that connection is made or from the midpoint of the busbar and thence along the first heating element to the first interconnecting element, is approximately a distance of $\lambda/4+n(\lambda/2)$ where n is an integer and $n \geqq 0$ and $\lambda$ is a selected wavelength from the band of signals to be received, $\lambda$ being appropriately calculated for the transmission medium e.g. glass.

Preferably, for each first interconnecting element the path length from the respective DC connection or the midpoint of the busbar, along the busbar to which that connection is made, and thence along the second heating element to the first interconnecting element, is also approximately a distance of $\lambda/4+n(\lambda/2)$ where $n \geqq 0$. The choice of n=0 has been found in practice to be a particularly preferred solution of the present invention.

In one example, a typical array of conductive elements may include 10–20 heating elements. For each first interconnecting element, the relevant path length to the junction between each first interconnecting element and the top and bottom heating elements will meet the criteria explained above.

In this way, by providing a substantially linear interconnecting element it is possible to provide an antenna with greater aesthetic appeal whilst still retaining some or all of the advantages of the prior art construction shown in GB2293693.

Preferably the antenna also includes a plurality of second interconnecting elements. In one embodiment, there is one second interconnecting element for each first interconnecting element and preferably the first and second interconnecting elements are arranged into one, two or more pairs each pair consisting of a first and a second interconnecting element. This arrangement provides the additional advantage of duplication, since the effect of a breakage in one of the wires of a pair, or the functioning of the antenna is minimised because of the presence of the second wire in the pair.

Preferably for one, some or all pairs of interconnecting elements, each pair of elements extend roughly parallel to one another and are preferably between 2 and 8 cms apart, more preferably between 3 and 7 cms apart, more preferably between 4 and 6 cms apart and most preferably approximately 5 cms apart.

Preferably for each second interconnecting element, the path length from the respective DC connection, along the busbar to which that connection is made and thence along the second heating element to the second interconnecting element, is approximately a distance of $\lambda/4+n(\lambda/2)$ where n is an integer and $n \geqq 0$.

For example, for a pair of first and second interconnecting elements, the path length to e.g. the top or bottom of the first interconnecting element meets the stated criteria whilst the path length to the e.g. bottom or top (as appropriate) of the second interconnecting element meets the stated criteria. In this way, when the pair of elements is considered as a functional unit, both its top and bottom ends will approximately meet the path length criteria. In an alternative embodiment, the antenna elements may be located such that respective points (e.g. midpoints) between a pair of first and second interconnecting elements on the first and second heating elements located meet the path length criteria.

In a particular preferred embodiment, the antenna includes two pairs of interconnecting elements, with each one being associated with a respective one of the DC power connection to busbars. The use of one or more pairs of interconnecting elements has proved in practice to improve the antenna characteristics.

In a further aspect the invention provides an antenna for receiving radio signals e.g. in a vehicle, the antenna including an array of conductive elements formed on a window pane e.g. of a vehicle, the array including first and second busbars extending close to respective opposite edges of the pane and a plurality of generally parallel, spaced-apart heating elements interconnecting the busbars;

there being a respective connection for DC power to each busbar;

a plurality of first interconnecting elements, each first interconnecting element extending between first and second heating elements and crossing at least one other heating element, each first interconnecting element being disposed around a respective one of said DC connections such that for each first interconnecting element length from the respective DC connection, along the busbar to which that connection is made or from the midpoint of the busbar, and thence along the first heating element to the first interconnecting element, is approximately a distance of $\lambda/4+n(\lambda/2)$ where $n \geqq 0$ and $\lambda$ is a selected wavelength from the band of signals to be received; and connection means for connecting the antenna to radio equipment and communicating received signals thereto, the connection means being connected to one of the busbars.

This provides a more convenient point for connecting the antenna to the radio receiver than was previously taught by GB 2293693. As will be seen from FIG. 1, GB 2293693 teaches that the appropriate connection position is to the central area of the antenna.

Preferably the connection means are located near to one of the ends of the busbar e.g. within 10 cms or preferably 5 cms of bar end. Again this provides a convenient connection point in most vehicles. Preferably the DC connection points to the selected busbar is located at a "null point" in relation to the received radio waves. This helps reduce or prevent undesirable attenuation of the received radio signal.

Alternatively, rather than the connection means being connected to one of the busbars, it may be connected to one or more of the heating elements in the vicinity of the busbars. By "in the vicinity" is meant preferably within 10 cms and more preferably within 5 cms. In one example, the connection means may include a separate connecting element connecting two or more of the heating elements. For example, the connection element may connect the two topmost heating elements or the two bottommost heating elements.

Alternatively, one of each respective pair of interconnecting elements may include an extension, the extension extending from the bottommost heating element and connecting to a further conducting element disposed substantially parallel to the interconnecting elements which extend between the busbars.

The further conducting element preferably extends to one side of the antenna and then again extends substantially at right angles in the direction of the main body of the antenna, terminating at a feed point which serves as the radio signal feed connection. The impedance of the side extension of the further conducting element may then be controlled by making a transmission line, which is done by placing an area of conducting material close to the extension of the further conducting element or strip and earthing it.

Preferably the adhesive, used to fix the rear window into the rear window aperture of the vehicle, has electrically conductive properties and covers partially or entirely the area of conductive material on the glass and provides an earth connection. This enables a transmission line impedance Zo of 75 Ohms (or if preferred or specified by a car maker, 50 or 100 Ohms, or other specified figure) to be achieved. This side feeding technique is particularly useful since most manufacturers now prefer a 'C' pillar mounted choke module.

In a third aspect, the present invention provides an antenna including an array of conductive elements formed on a window pane e.g. of a vehicle, capacitive coupling means also formed on the window pane, the capacitive coupling means being electrically connected to the antenna, electrical connection means for connecting, in use, the capacitive coupling means to the body surrounding the aperture in which the window is located.

The appropriate selection of the parameters of the capacitive coupling allows the antenna as a whole to be suitably tuned. With this aspect of the invention, the parameters of the capacitive coupling can be more accurately controlled i.e. the tuning can be more accurately controlled, as the capacitive coupler is not dependent on the precise location of the window in the aperture. With the prior art, as shown in FIG. 2, it will be appreciated that part of the capacitive coupler is in fact the body of the aperture itself and therefore the value of capacitive coupling will depend on the precise location of the window and may vary from, for example, vehicle to vehicle.

Preferably the electrical connection means includes an area of conductor formed on the window which, when the window is fitted into an aperture, will be in connection with the adhesive used to secure the window. Such adhesives are typically electrically conductive, thereby providing the required conduction path to the body surrounding the aperture.

Any of the above aspects may be used separately or in conjunction with any or all of the other aspects.

The interconnecting elements are advantageously disposed such that they interconnect points of substantially equal potential of the electrical heating supply. In this way, substantially no heating current will flow through them, allowing them to be formed as fine conductors.

In an antenna of the present invention, typically all of the conductive paths are formed by printing or deposition onto the pane.

In a further aspect, the invention provides a glass pane for a vehicle including an antenna according to any or all of the above aspects wherein the array of conductive elements are disposed to constitute a heater for the pane.

Such a glass pane may be fitted to a motor vehicle during manufacture to provide that vehicle with an antenna for receiving radio broadcasts.

The busbars of a glass pane as defined above are advantageously tuned to resonate within the desired frequency range.

In a further aspect, the invention provides a vehicle incorporating a pane of glass according to the above aspect of the invention for use as a radio antenna.

Embodiments of the present invention will now be described with reference to the accompanying drawings in which.

Figure 1:
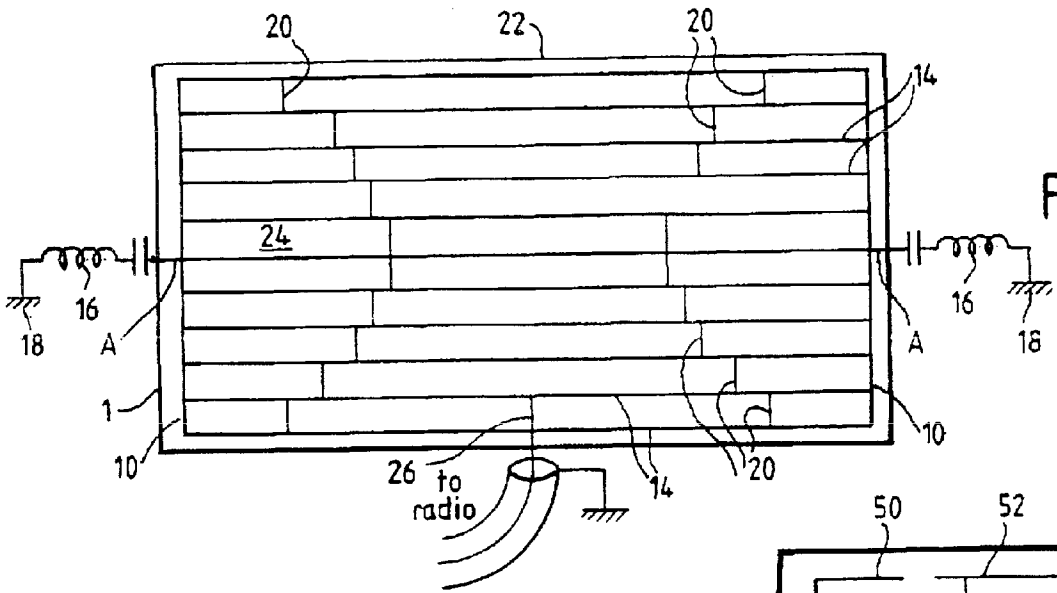
FIG. 1 shows a prior art antenna as disclosed in GB 2293693.
Figure 2:
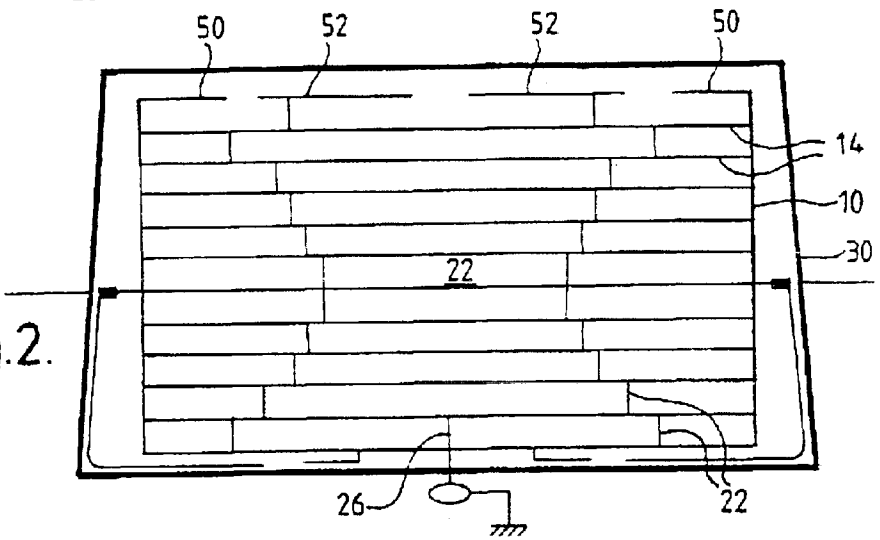
FIG. 2 shows a prior art antenna using capacitive coupling as disclosed in GB 2293693.
Figure 3:
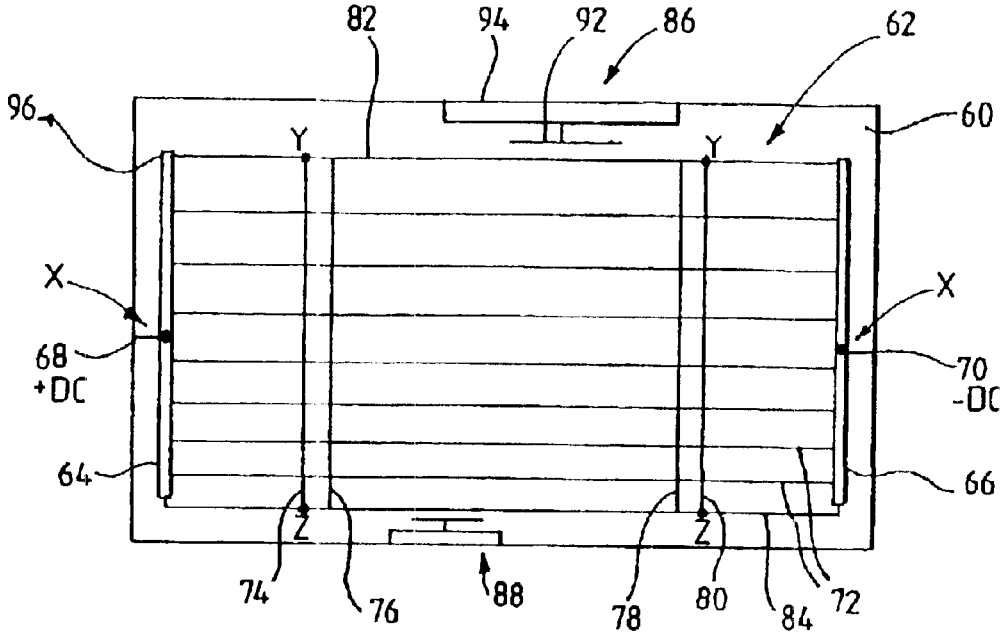
FIG. 3 shows an embodiment of an antenna according to aspects of the present invention.

FIG. 3 shows a window 60 onto which is printed an array of conductive elements generally indicated 62. The array includes a first busbar 64 and a second busbar 66 and there are respective DC connections 68, 70 to busbars 64, 66. The DC connections are indicated as positive and negative but of course one of the connections may be in fact earth and/or connected to the body of the e.g. vehicle in which the window is located. There are a number of generally parallel heating elements 72 interconnecting the busbars 64, 66.

In this example there are four interconnecting elements 74, 76, 78 and 80. The elements are arranged in two pairs—74, 76 and 78, 80. The two first interconnecting elements are designated 74 and 80 and the two second interconnecting elements are designated 76 and 78. In this example, there is a defined path length from the point of DC connection to the busbar (marked "X") (which is also the midpoint in this example) to the points Y and Z at which the first interconnecting elements 74, 80 connect to the first and second heating elements 82 and 84 respectively. This path length x-y and x-z is selected to be approximately a distance of $\lambda/4+n(\lambda/2)$ where $n \geqq 0$ and $\lambda$ is a selected wavelength from the band of signals to be received. Typically the selected wavelength is approximately midband and, for example, in Europe the VHF broadcast band is approximately 88–110 MHz and in Japan it is approximately 76–90 MHz. A typical value for x-y and y-z is 50 to 53 cm.

As explained previously, the points Y and/or Z could instead be the points at which the second interconnecting elements 76, 78 meet the first and second heating elements 82, 84 respectively. Alternatively the points Y and/or Z could be somewhere between the points at which the first and second interconnecting elements meet the first and second heating elements.

It will be noted that the interconnecting elements cross the heating elements at approximately equipotential points of the heating elements. In other words, substantially no heating current flows in the interconnecting elements.

Figure 4:
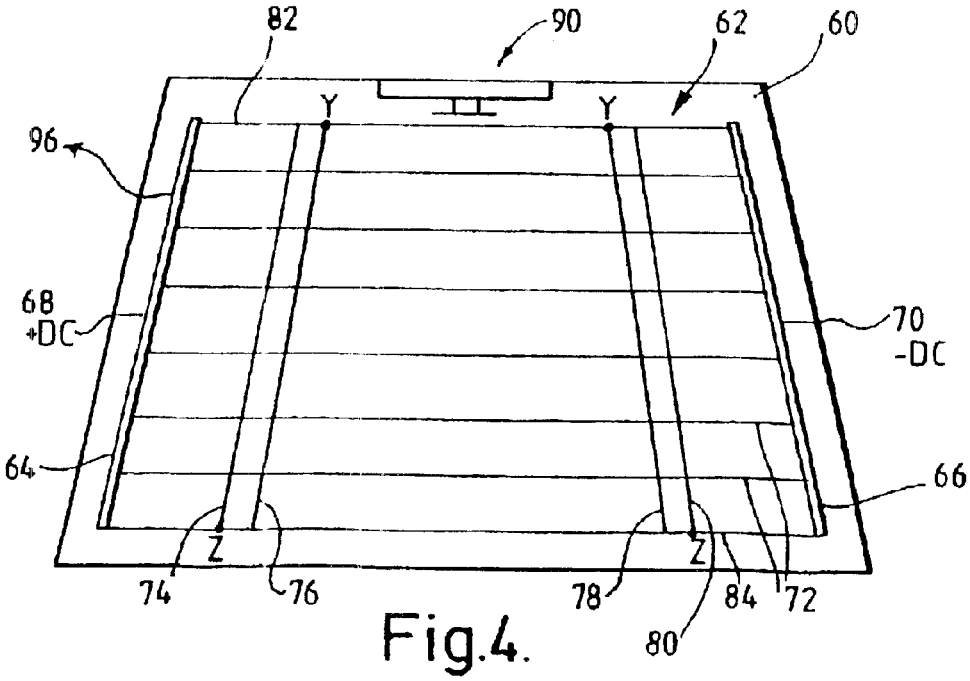
FIG. 4 shows an embodiment of an antenna according to aspects of the present invention.

FIG. 4 illustrates a second embodiment of the invention in which the window is of the more common trapezoidal shape. In this case, in order that the interconnecting elements cross the heating elements at approximately equipotential points, the interconnecting elements are not parallel to the busbars. In this case, points Y is the point at which the second interconnecting elements 76, 78 meet the first heating element 82. Points Y and Z similarly are the points at which the first interconnecting element 74, 80 meet the second heating element 84. As above, Y and/or Z could be varied.

Typically first and second interconnecting elements 74, 76 (and similarly elements 78, 80) are around 5 cms apart and preferably in the range of 4–6 cms apart. Typically the interconnecting elements of each pair are approximately parallel to each other, although as will be seen in FIG. 4 this will only be approximate in order to ensure that both interconnecting elements cross the heating elements at equipotential points.

Preferably coupling structures are used to tune the antenna so that the whole system (including busbars and interconnecting elements) can be brought to couple and resonate with the perimeter of the e.g. metalwork surrounding the window. Typically this perimeter is the inside edge of the hole in the vehicle body into which the rear window is fixed. Such coupling structures may be located at suitable points around the perimeter of the window e.g. at the top and/or bottom.

FIG. 3 illustrates coupling structure 86 and 88 located at the top and bottom of the windows respectively. The antenna of FIG. 4 includes only coupling structure 90 located near the top of the window. Taking coupling structure 86 as an example, the capacitive coupler consists of a capacitive element 92 electrically connected to a relatively large area of conductor 94. The distance and relative sizes between the capacitive element 92 and, in this example, the first heating element 82 are selected to provide the desired degree of capacitive coupling. The location of the area of conductor 94 is such that it will be in contact with the adhesive which is used to fix the window in the window aperture. Such adhesive is typically conductive and so effectively the capacitive coupling element 92 will be in electrical connection with the perimeter of the aperture via conductor 94 and the adhesive (not shown).

It is believed that four high current VHF radio frequency paths are set up, consisting of the two busbars 64, 66 and the two pairs of interconnecting elements. Signals can therefore be taken from the antenna at a number of points and in FIG. 3 the VHF output 96 is connected in the region of the upper corner of busbar 64, whereas in FIG. 4 it will be seen that the VHF output 96 is connected to busbar 64 approximately midway between the DC connection 68 and the end of the busbar. This has been found to be more convenient for car manufacturers.

Figure 5:
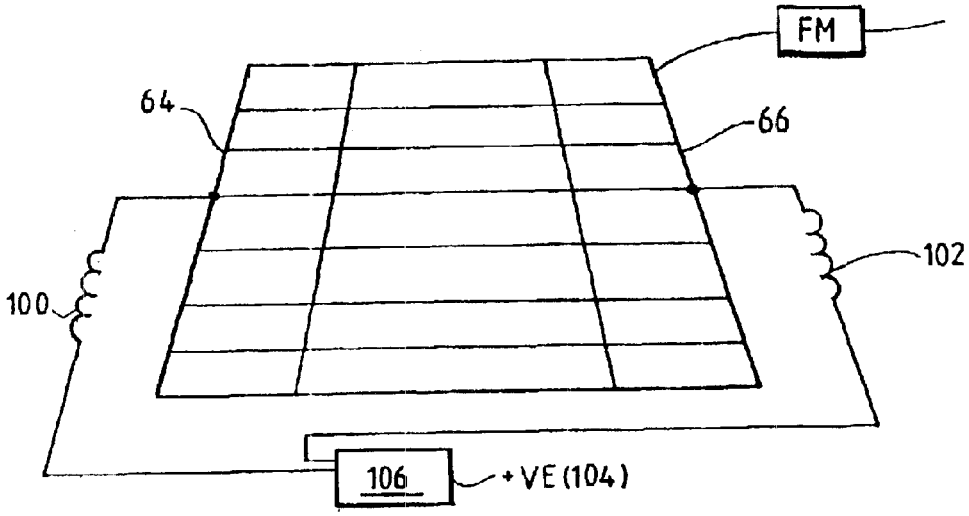
FIG. 5 shows a third embodiment of an antenna according to aspects of the present invention.

FIG. 5 shows a pair of in line VHF chokes 100, 102 each connecting a respective one of the busbars 64, 66 to a source 104 for supplying DC current to the heating elements via the busbars. The chokes are optional, as can be seen from FIG. 6. A secondary module 106 may also be included in the DC circuit. The module 106 may be designed with a specific impedance. The aim is that the referred value of the impedance at the busbar end of the wires is of a desired magnitude and phase angle so as to promote efficient operation of the antenna system. These values are typically but not necessarily open or short circuit.

Figure 6:
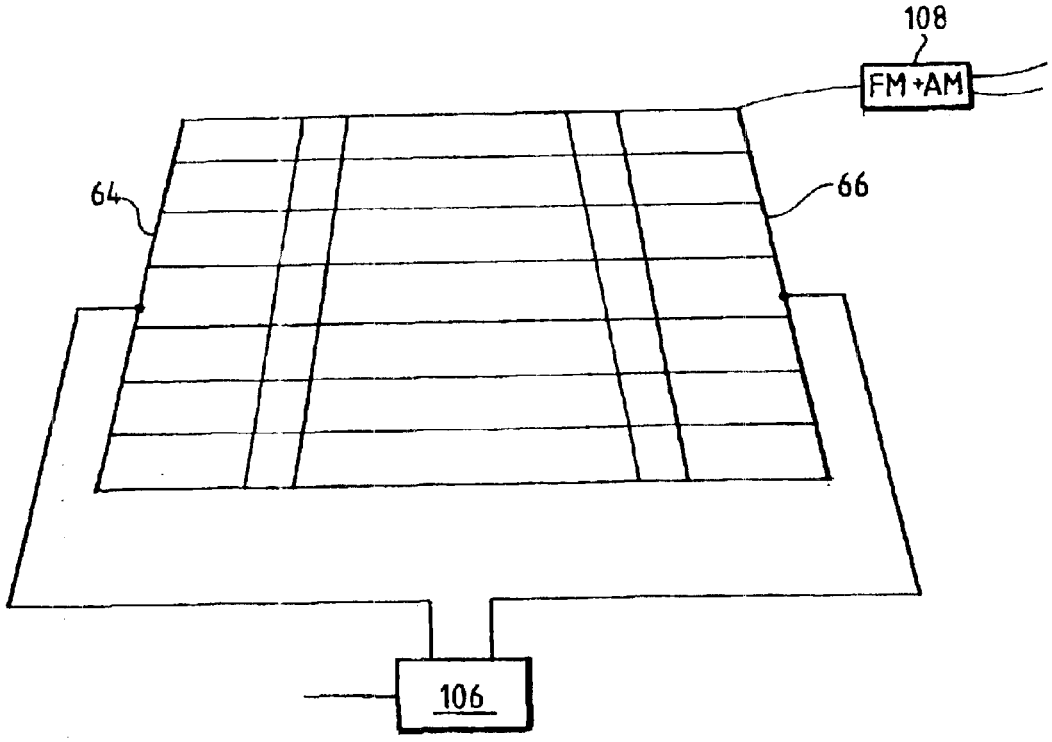
FIG. 6 shows a fourth embodiment of an antenna according to aspects of the present invention.

The secondary module 106 may also include a bifilar choke, for example as shown in UK Patent No. 2266193 or 2295729. As can be seen in FIG. 6, this permits AM signals to be picked up and processed by the signal reception module 108, in addition to VHF signals.

Figure 7:
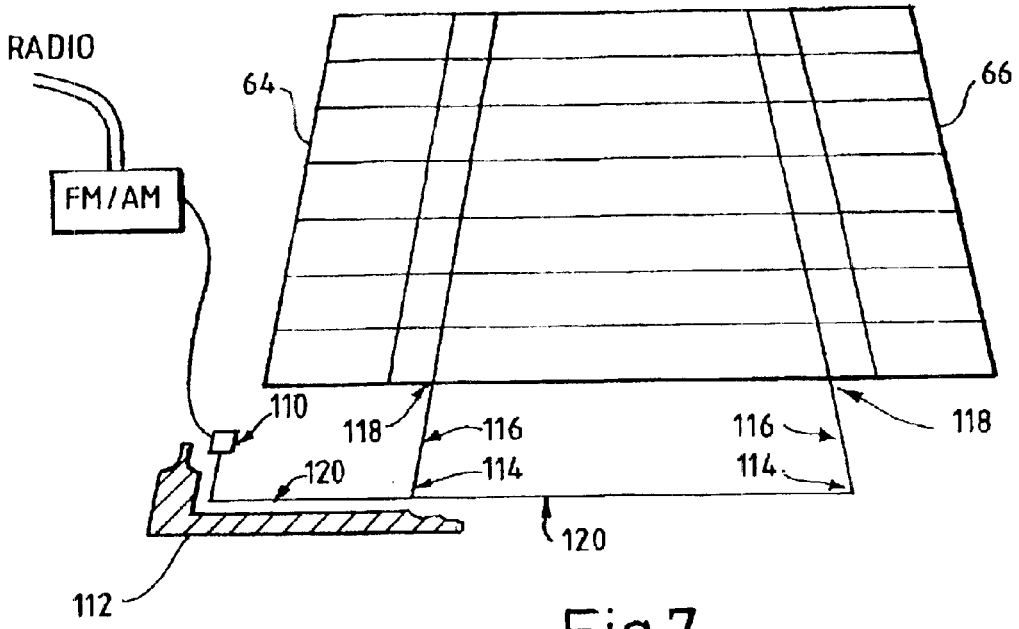
FIG. 7 shows a further embodiment of the antenna according to the invention.

FIG. 7 shows an alternative connection arrangement wherein one of each respective pair of interconnecting elements includes an extension (116), each extension extending from the bottommost heating element and connecting to a further conducting element (120) substantially parallel to the interconnecting elements which extend between the busbars (64, 66). The further conducting element (120) extends to one side of the antenna for a certain distance and then extends substantially at right angles to the further conducting element (120), in the direction of the main body of the antenna, and terminating at a feed point (110), which serves as the radio signal feed connection. The impedance of the side extension (120) of the further conducting element is controlled by making a transmission line, which is done by placing an area of conducting material (112) close to the extension of the further conducting element or strip (120) and earthing it. The adhesive, used to fix the rear window into the rear window aperture of the vehicle, has electrically conductive properties and covers partially or entirely the area of conductive material (112) on the glass and provides an earth connection. This enables a transmission line impedance Zo of 75 Ohms (or if preferred or specified by a car maker, 50 or 100 Ohms, or other specified figure)to be achieved. This side feeding technique is particularly useful since most manufacturers now prefer a 'C' pillar mounted choke module.

The above embodiment is given by way of example only and variations will be apparent to those skilled in the art.

What is claimed is:

1. An antenna for the reception of radio signals, the antenna including:

an array of conductive elements formed on a window pane, the array including first and second busbars extending close to respective opposite edges of the pane and a plurality of generally parallel, spaced-apart heating elements interconnecting the busbars;

each busbar being provided with a respective connection for DC power;

a plurality of first interconnecting elements, each first interconnecting element extending between first and second heating elements and crossing at least one other heating element, each first interconnecting element being substantially linear and disposed such that, for each first interconnecting element, the length from the mid-point of a busbar to the point of connection of the first interconnection element with the first heating element, measured along the busbar and then along the first heating element, is approximately a distance of $\lambda/4+n(\lambda/2)$ where n is an integer and $n \geqq 0$ and $\lambda$ is a selected wavelength from the band of signals to be received; and a plurality of second interconnecting elements, each second interconnecting element extending between first and second heating elements and crossing at least one other heating element, a second interconnecting element being provided for each first interconnecting element, wherein the first and second interconnecting elements are arranged into one, two or more pairs, each pair consisting of a first and a second interconnecting element.

2. An antenna according to claim 1, wherein for each first interconnecting element, the path length from the mid-point of a busbar to the point of connection of the first interconnecting element with the second heating element, measured along the busbar and then along the second heating element is also approximately a distance of $\lambda/4+n(\lambda/2)$ where n is an integer and $n \geqq 0$.

3. An antenna according to claim 1, wherein at least one of said pairs of interconnecting elements extend roughly parallel to one another and are spaced between 2 and 8 cm apart.

4. An antenna according to claim 1, wherein at least one of said pairs of interconnecting elements extend roughly parallel to one another and are spaced approximately 5 cm apart.

5. An antenna according to claim 1 wherein the antenna includes two pairs of interconnecting elements, with each pair being associated with a respective one of the DC power connections to busbars.

6. An antenna according to claim 1, wherein for each second interconnecting element, the path length from the mid-point of a busbar to the point of connection of the second interconnecting element with the second heating element measured along the busbar and then along the second heating element, is approximately a distance of $\lambda/4+n(\lambda/2)$ where n is an integer and $n \geqq 0$.

7. An antenna according to claim 1, wherein the path length from the midpoint of a busbar to the point of connection of the first interconnecting element of a pair of interconnecting elements with either the first or second heating element, measured along the busbar and then along said first or second heating element, is approximately a distance of $\lambda/4+n(\lambda/2)$ where n is an integer and $n \geqq 0$, while the path length from the mid-point of a busbar to the point of connection of the second interconnecting element of said pair with the other of said first or second heating elements, measured along the busbar and then along said first or second heating element, is approximately a distance of $\lambda/4+n(\lambda/2)$ where n is an integer and $n \geqq 0$.

8. An antenna according to claim 1, wherein the interconnecting elements are located such that the path length from the mid-point of a busbar to points on the first and second heating elements located between a pair of first and second interconnecting elements, measured along the busbar to the which that connection is made and their respective heating elements, is approximately a distance of $\lambda/4+n(\lambda/2)$, where $n \geqq 0$.

9. An antenna according to claim 8 wherein the path length is measured to the mid-points, between a pair of first and second interconnecting elements, on the first and second heating elements.

10. An antenna according claim 1, wherein the antenna includes connection means for connecting the antenna to radio equipment and communicating received signals thereto, the connection means being connected to one of each respective pair of interconnecting elements, and wherein the connection means extends in close proximity to an area of conducting material which is itself connected to earth through adhesive which, in use, fixes the window in the aperture, said adhesive being electrically conducting.

11. An antenna according to claim 1, wherein one of each respective pair of interconnecting elements includes an extension, each extension extending from the bottommost heating element and connecting to the connection means which terminates at a feed point at one side of the antenna, which serves as the radio signal feed connection, wherein the impedance of the connection means is determined by making a transmission line using the area of conducting material.

12. A glass pane for a vehicle including an antenna according to claim 1, wherein the array of conductive elements are disposed to constitute a heater for the pane.

* * * * *